US007275333B1

(12) United States Patent
Neuroth

(10) Patent No.: US 7,275,333 B1
(45) Date of Patent: Oct. 2, 2007

(54) TOOL FOR INSTALLING SIDING

(76) Inventor: David H. Neuroth, 18285 S. 4185 Rd., Claremore, OK (US) 17017

( * ) Notice: Subject to any disclaimer, the term of this patent is extended or adjusted under 35 U.S.C. 154(b) by 0 days.

(21) Appl. No.: 11/398,223

(22) Filed: Apr. 5, 2006

Related U.S. Application Data

(60) Provisional application No. 60/668,660, filed on Apr. 6, 2005.

(51) Int. Cl.
*G01D 21/00* (2006.01)

(52) U.S. Cl. ..... 33/647; 33/646; 269/904

(58) Field of Classification Search ..... 33/646, 33/647, 648, 649; 269/6, 36, 170, 904
See application file for complete search history.

(56) References Cited

U.S. PATENT DOCUMENTS

| | | | | | |
|---|---|---|---|---|---|
| 377,178 | A * | 1/1888 | Traut | ..... | 33/647 |
| 390,459 | A * | 10/1888 | Davis | ..... | 33/646 |
| 1,598,986 | A * | 9/1926 | Ping | ..... | 33/647 |
| 4,155,175 | A | 5/1979 | Stiles | | |
| 4,314,429 | A * | 2/1982 | Casteel et al. | ..... | 33/647 |
| 4,425,714 | A | 1/1984 | Kelly, Jr. | | |
| 5,291,719 | A * | 3/1994 | Buster | ..... | 269/904 |
| 5,408,757 | A | 4/1995 | Lenz | | |
| 5,465,499 | A | 11/1995 | LaPlante | | |
| 5,623,767 | A | 4/1997 | Colavito | | |
| 5,692,311 | A | 12/1997 | Paquin | | |
| D406,069 | S | 2/1999 | Boyce | | |
| 6,367,160 | B1 | 4/2002 | Rempe | | |
| 6,814,334 | B1 * | 11/2004 | Whitehead | ..... | 269/904 |
| 6,848,192 | B2 | 2/2005 | Partin | | |
| 7,124,551 | B1 * | 10/2006 | Patera | ..... | 33/647 |
| 7,134,253 | B2 * | 11/2006 | Edwards et al. | ..... | 33/648 |
| 7,168,181 | B2 * | 1/2007 | Walchak | ..... | 33/647 |

* cited by examiner

*Primary Examiner*—Yaritza Guadalupe-McCall
(74) *Attorney, Agent, or Firm*—Bracewell & Giuliani LLP

(57) ABSTRACT

A siding tool is used to position overlapping siding planks. The tool has an elongated member with a hook on an upper end that fits over an upper edge of a first plank. A support is carried by the elongated member for supporting the lower edge of a second plank that overlaps the first plank. The elongated member and the hook are upwardly movable from the engaged position. The hook is rotatable to a disengaged position once moved above the upper edge of the first plank. The disengaged position allows the tool to be withdrawn by pulling downward.

19 Claims, 4 Drawing Sheets

TOOL FOR INSTALLING SIDING

CROSS REFERENCE TO RELATED APPLICATION

This application claims priority to provisional application Ser. No. 60/668,660, filed Apr. 6, 2005.

FIELD OF THE INVENTION

This invention relates in general to hand tools, and particularly to a hand tool for positioning siding planks when installing on a building.

BACKGROUND OF THE INVENTION

When plank siding is applied to a side of a building, each newly installed plank overlaps the previously installed plank by a given amount. The amount of overlap needs to remain fixed from plank to plank to keep the siding level and neatly spaced.

The most common means of achieving this outcome is by having workmen hold the plank being applied at each end using a pattern measurement block. Once aligned, the plank is nailed in place and the handheld supports removed. This technique is labor intensive because long planks require at least two people to perform the task.

A number of tools are disclosed in patents for assisting in installing siding planks. Improvements are needed, however. The tool needs to be quickly installed and quickly removed once the plank is fastened to the building. Also, to make it economical, a single workman should be able to install long siding planks.

SUMMARY OF THE INVENTION

In this invention, two embodiments of a tool for positioning overlapping siding planks are shown. Both embodiments have an elongated member with a hook on an upper end. The hook fits over the upper edge of a first or lower plank fastened to a structure. A support is carried by the elongated member for engaging the lower edge of a second or next upward siding plank. The hook of the elongated member and the support will hold the second plank in a desired position to enable the workman to fasten the second plank to the structure.

After fastening, the elongated member is upwardly movable from the engaged position, and the hook is rotatable to a disengaged position approximately 90 degrees from the engaged position. This allows the workman to pull the elongated member and hook down from between the two overlapping siding planks.

In one embodiment, the hook and elongated member will flex when twisted from a natural position to a position about 90 degrees from the natural position. A retainer mechanism holds the hook in this cocked position, retaining the a torque imposed on the elongated member. When the elongated member is pushed upward, the upper edge of the hook will clear the first siding plank, releasing the torque and causing the hook to spring back to its natural, disengaged position.

In the second embodiment, the elongated member does not undergo torque as in the first embodiment. A spacer is located below the support. The spacer is rotatable relative to the elongated member and the support. A mating lug and groove between the elongated member and the spacer, when misaligned, prevents upward movement of the elongated member relative to the support and also transfers the weight of the second plank from the support to the elongated member. When the lug and groove are aligned by the workman, upward movement of the elongated member moves the hook above the upper edge of the lower plank. This upper position allows the workman to rotate the hook approximately 90 degrees to the disengaged position.

DETAILED DESCRIPTION OF THE INVENTION

Figure 1:
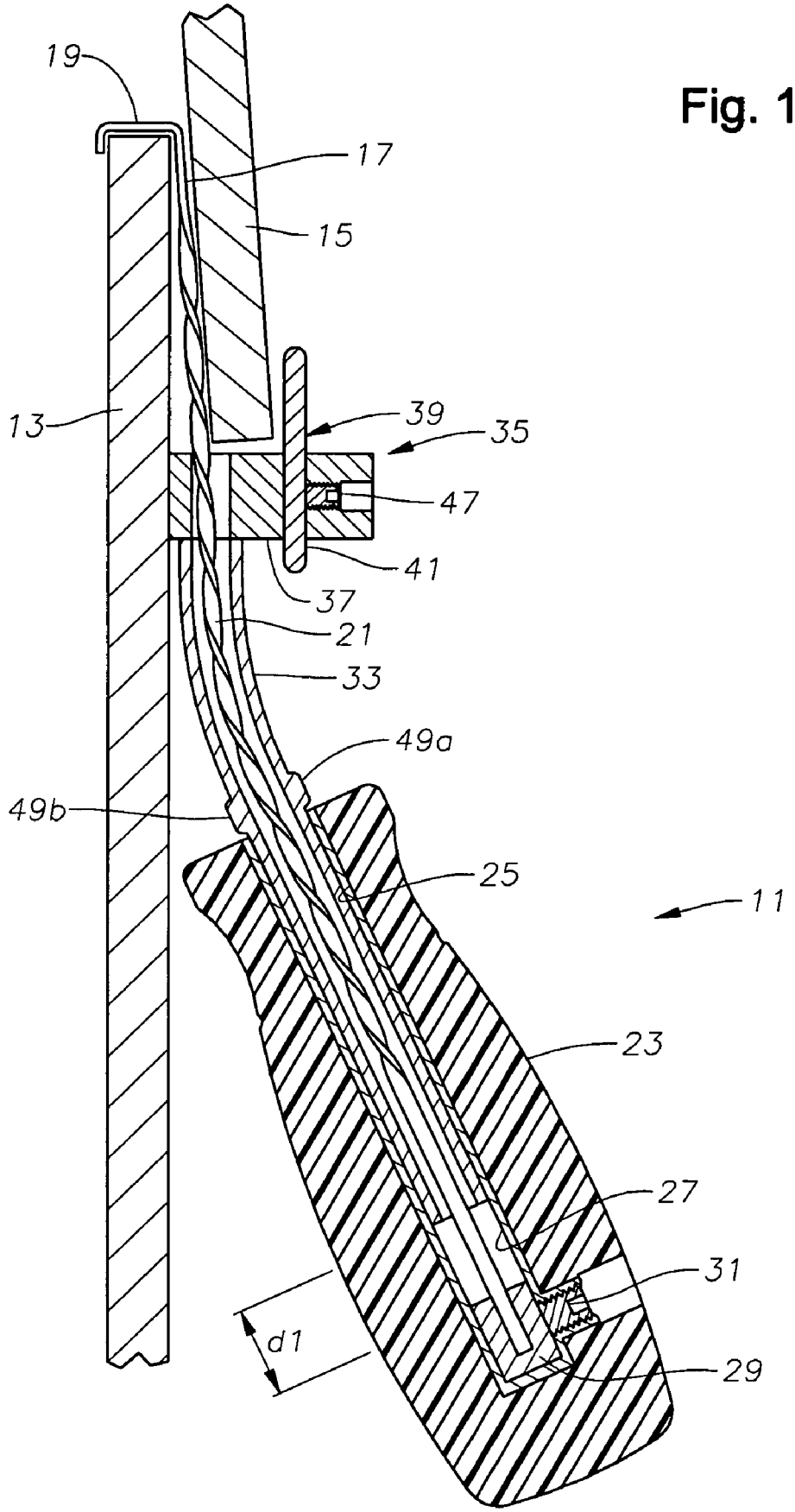
FIG. 1 is a vertical sectional view illustrating a first embodiment of a siding tool constructed in accordance with this invention and shown supporting an upper siding plank overlapped with a lower siding plank.

Referring to FIG. 1, tool 11 is a handheld manually operated device for use by a workman to position first and second planks 13, 15 relative to each other. The lower siding plank 13 has previously been fastened to a structure of a building (not shown) by screws or nails. The next upper siding plank 15 is shown in a position for fastening to the structure. Siding plank 15 has a lower edge that overlaps the upper portion of siding plank 13 by a fixed amount.

Tool 11 has a torsion member 17 that in this embodiment comprises an elongated strip of spring steel that can be twisted 90 degrees without exceeding the yield strength of the steel. Torsion member 17 has an upper portion bent permanently into a hook 19. Hook 19 is generally rectangular and sized for fitting over the upper edge of plank 13. In this embodiment, torsion member 17 also has a plurality of permanent twists 21 formed in it and extending over most of its length. Twists 21 facilitate a user applying torque to torsion member 17.

Tool 11 has a handle 23 for gripping by a workman. Handle 23 has a central axial hole 25 extending throughout most of its length. Preferably, a metal liner 27 forms a sheath in at least part of hole 25, although this would not be necessary if handle 23 were made of sufficiently rigid material. The lower end of torsion member 17 is permanently secured within a slot in a cylindrical anchor 29 located at the bottom of hole 25. A set screw 31, engageable through a laterally extending passage in handle 23, locks anchor 29 rigidly to handle 23. The purpose of anchor 29 is to rigidly secure the lower end of torsion member 17 to handle 23. Other arrangements for securing the lower end of torsion member 17 to handle 23 could be employed.

A guide tube 33 has a lower portion that is closely received within liner 27. Guide tube 33 is able to rotate relative to handle 23 as well as move axially. Guide tube 23 has an upper portion that protrudes above handle 23 and is preferably gradually curved to facilitate use of tool 11.

Figure 2:
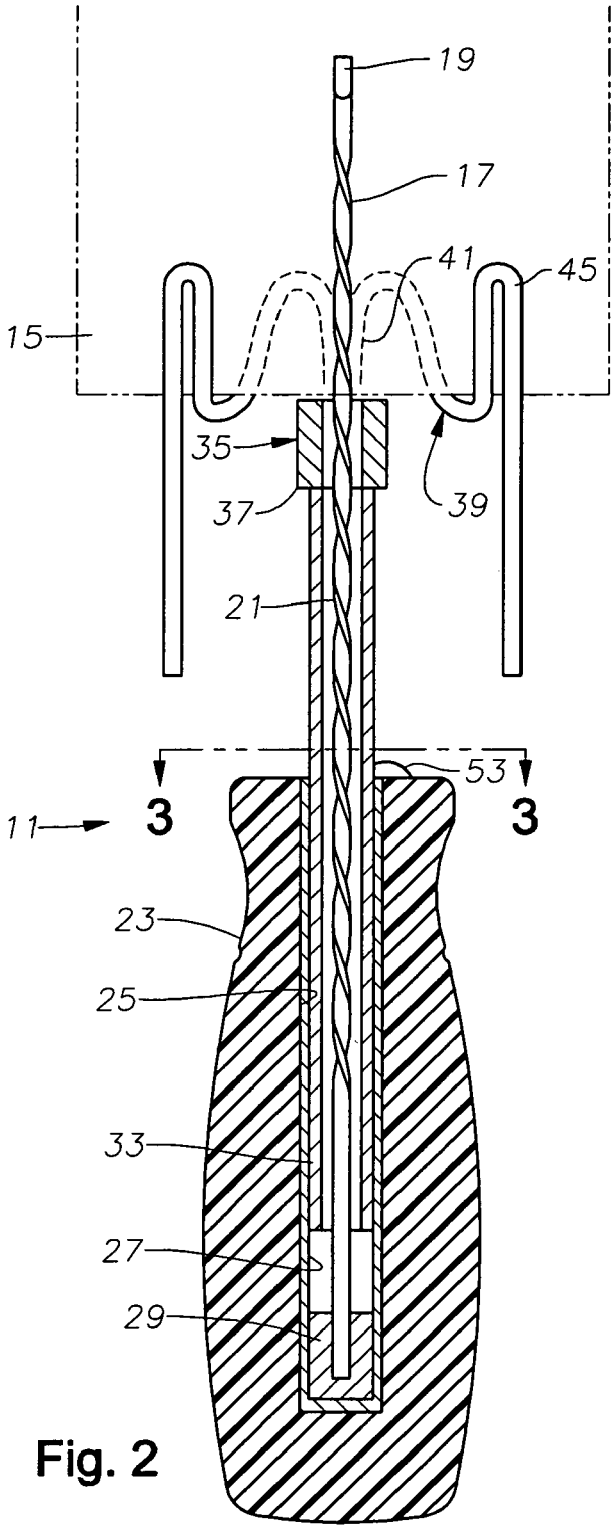
FIG. 2 is a vertical sectional view of the siding tool of FIG. 1, taken 90 degrees from the position shown in FIG. 1.

A support assembly 35 is secured to the upper end of guide tube 33 for supporting the lower edge of plank 15. Torsion member 17 extends through guide tube 33 and through a hole provided in support assembly 35. Support assembly 35 includes a base 37 that holds a shelf 39 in this embodiment. As shown in FIG. 2, in this example, shelf 39 is formed from a single wire bent to have a leg portion 41 that extends through a hole within base 37 to connect shelf 39 to base 37. Shelf 39 has two spaced-apart U-shaped portions that define a back 45 for retaining the lower edge of plank 15. As shown in FIG. 1, a set screw 47 holds shelf 39 in position and also allows it to be adjusted upward and downward relative to base 37 to vary the desired overlap between planks 13 and 15. A wide variety of shelves, other than one configured by wire, can also be employed.

Figure 3:
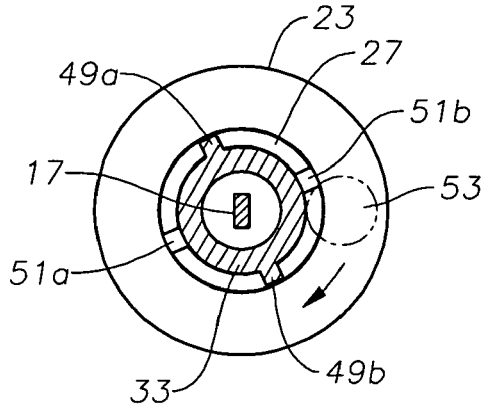
FIG. 3 is a sectional view of the siding tool as shown in FIG. 2, prior to the torque retaining mechanism being cocked.

Referring again to FIG. 1, guide tube 33 has two lugs 49*a*, 49*b* spaced 180 degrees apart from each other. Each lug 49*a*, 49*b* protrudes from the exterior sidewall of guide tube 33 and is a thin axially extending protuberance. Referring to FIG. 3, liner 27 has two grooves 51*a*, 51*b*, spaced 180 degrees apart from each other. Grooves 51*a*, 51*b* extend axially into hole 25 of handle 23.

When handle 23 is in the position relative to guide tube 33 shown in FIGS. 1 and 3, lugs 49*a*, 49*b* are misaligned with grooves 51*a*, 51*b*. If an upward force is applied to handle 23 while lugs 49*a*, 49*b* are misaligned and guide tube 33 held stationary, the upper end of handle 23 would contact lugs 49*a*, 49*b*, which would prevent upward movement of handle 23 relative to guide tube 33 and support 35. When handle 23 is rotated relative to guide tube 33 to the aligned position shown in FIG. 4, lugs 49*a*, 49*b* are aligned with grooves 51*a*, 51*b*, which allows handle 23 to be pushed upward relative to guide tube 33 and support 35. When handle 23 is pushed upward, lugs 49*a*, 49*b* will slide into liner 27, and hook 19 will move above the upper edge of first plank 13. Although two lugs 49*a*, 49*b* and two grooves 51*a*, 51*b* are shown, more lugs and grooves could be utilized or only a single lug and groove could serve the same purpose. Also, the lugs could be located in liner 27 and the grooves on guide tube 33 rather than the reverse, as shown.

Figure 4:
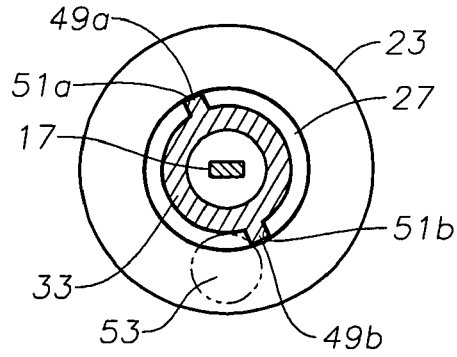
FIG. 4 is a sectional view similar to FIG. 3, but showing the torque retaining mechanism in a cocked position.
Figure 5:
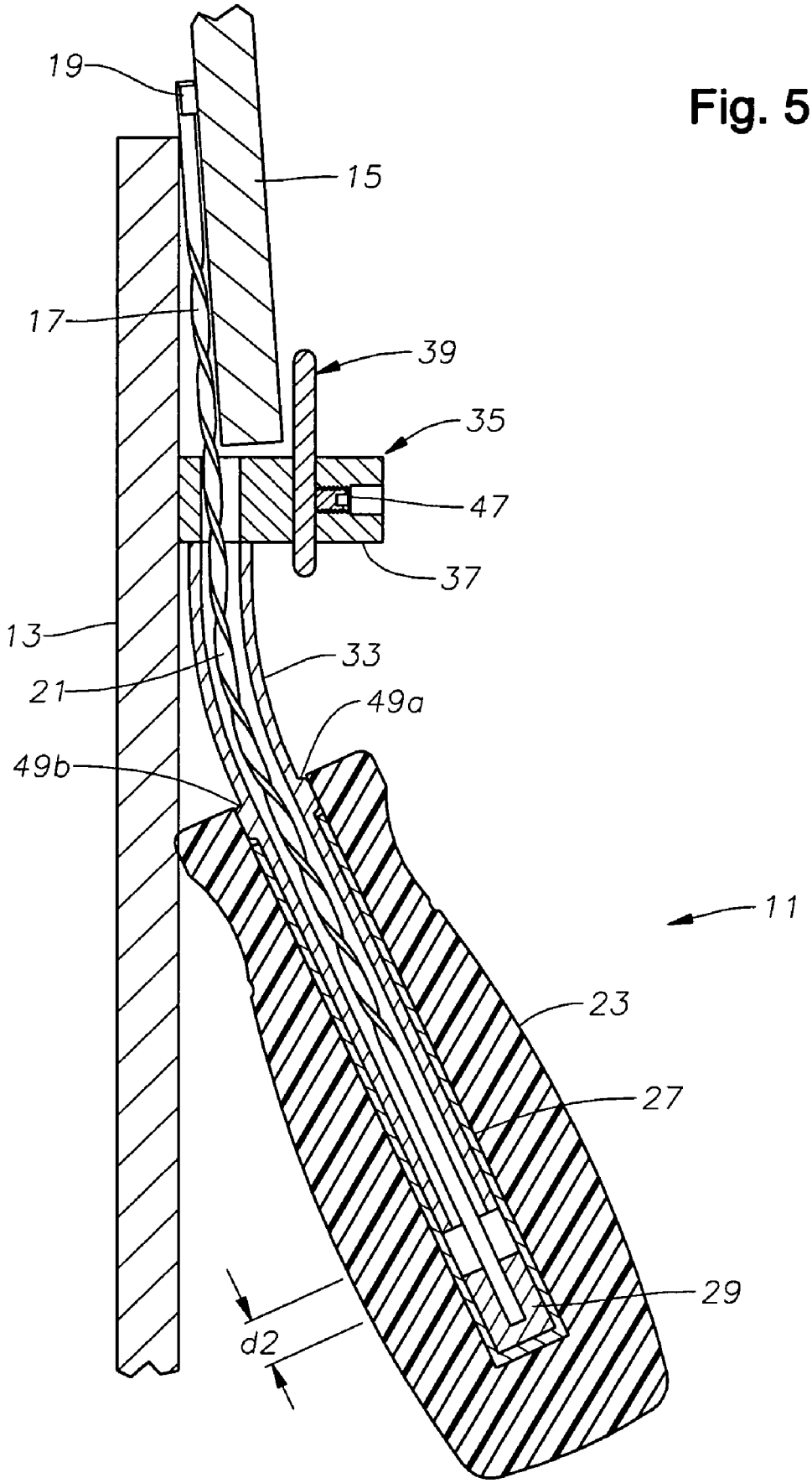
FIG. 5 is a sectional view of the tool of FIG. 1, taken in the same plane as FIG. 1, but showing the hook released from the lower plank and rotated 90 degrees back in its natural position.

Referring to FIGS. 2-4, a detent 53 is mounted to the upper end of handle 23. A portion of detent 53 overlays an upper edge of liner 27 so that when handle 23 is rotated relative to guide tube 33, one of the lugs 49*a*, 49*b* will be contacted by detent 53. Continued rotation causes detent 53 to slide under the lug, which is shown to be lug 49*b* in FIG. 4, informing the workman that approximately 90 degrees of twist has been imparted to handle 23. Also, when lug 49*b* snaps past detent 53, lugs 49*a*, 49*b* will be aligned with grooves 51*a*, 51*b*.

In operation of the tool of the embodiments of FIGS. 1-5, after first plank 13 has been installed, the workman will place one or more tools 11 in the position shown in FIG. 1, with their hooks 19 overlying the upper edge of first plank 13. For example, the workman may have two of the tools 11 spaced at opposite ends of plank 13. Lugs 49 will be spaced above the upper edge of handle 23 in misalignment with grooves 51, and torsion member 17 will be in its natural state, not under any torque. The workman places upper plank 15 on shelf 39, and the weight of upper plank 15 transfers from support 35 to guide tube 33, from guide tube 33 through lugs 49 to handle 23, and from handle 23 to torsion member 17 and hook 19. With lugs 49*a*, 49*b* touching the upper end of handle 23, a distance d1 will exist between the lower end of guide tube 33 and anchor 29. The workman then fastens upper plank 15 to the building with nails or screws. After upper plank 15 is secured, torsion member 17 will be trapped securely in the position shown in FIG. 1 by the overlapping engagement of upper plank 15.

To remove each tool 11, the workman first cocks tool 11 by rotating handle 23 approximately 90 degrees from the natural position shown in FIG. 1 and in FIG. 3. The rotation could either be clockwise or counterclockwise, but FIG. 3 shows clockwise rotation. As the workman rotates handle 23, the lower end of torsion member 17 will rotate with handle 23. Hook 19, however, cannot rotate with torsion member 17 because it is still in engagement with the upper edge of plank 13. Thus, the rotation will apply torque to torsion member 17. At the same time, detent 53 rotates with handle 23. Guide tube 33 and support assembly 35 do not rotate. When detent 53 contacts and snaps under lug 49*b*, which occurs after approximately 90 degrees of rotation, lug 49*b* will be in alignment with groove 51*b*. The workman exerts upward pressure on handle 23, which causes lugs 49*a*, 49*b* to slide into grooves 51*a*, 51*b*. Torsion member 17 moves upward with handle 23. Support shelf 39 cannot move upward because of the engagement with upper plank 15, which is now secured to the building. When lugs 49*a*, 49*b* first enter grooves 51*a*, 51*b*, tool 11 may considered to be cocked because torque is being held in torsion member 17.

Continued upward movement of handle 23 from the cocked position moves hook 19 above the upper edge of lower plank 13. Once cleared, the torque within torsion member 17 causes hook 19 to elastically spring 90 degrees to the natural position shown in FIG. 5. The distance between the lower end of guide tube 33 and anchor 29 is now d2, which is less than d1 (FIG. 1). Because hook 19 is now oriented in a plane parallel with upper plank 15, the workman can readily pull hook 19 and torsion member 17 from between the overlapping planks 13 and 15.

Referring to FIGS. 6-9, in this embodiment, tool 55 does not employ torsion but is similarly used to position first and second planks 57, 59 relative to each other. Tool 55 has an elongated member or rod 61 that has an integral hook 63 on its upper end. Hook 63 fits over an upper edge of first or lower plank 57. Tool 55 has a support 65 with a hole for the passage of rod 61. Support 65 has an upward extending back 67 and serves as a shelf for supporting the lower edge of plank 59. Support 65 is freely rotatable and axially movable on rod 61.

A spacer 69 is carried on rod 61 below support 65. Spacer 69 is also freely rotatable and axially movable to rod 61. Spacer 69 also can rotate relative to support 65. In the preferred embodiment, spacer 69 does not move axially relative to support 65, but it could, if desired. In this example, spacer 69 is a cylindrical spool-shaped member, but the configuration may vary. Spacer 69 has a laterally-extending spacer arm 71 that allows the user to grip and rotate spacer 69. Spacer 69 also has an axially extending slot or groove 73 formed on one side.

A collar 75 is rigidly secured to rod 61 below spacer 69. Rod 61 moves both axially and rotatably with collar 75. A set screw 77 locks collar 75 rigidly to rod 61 in this embodiment, but other arrangements could be employed. Collar 75 has an upward protruding tang or lug 79 for reception within groove 73. An arm 81 extends laterally from collar 75, serving as a handle for rotating collar 75 and rod 61.

Figure 6:
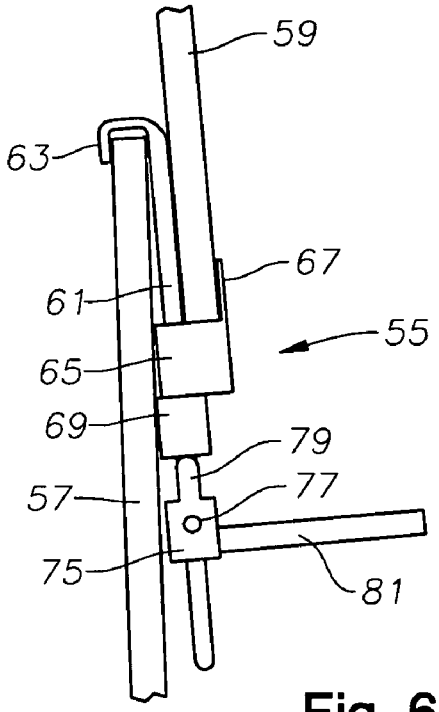
FIG. 6 is a side elevational view of a second embodiment of a siding tool, shown supporting an upper plank overlapped with a lower plank.
Figure 7:
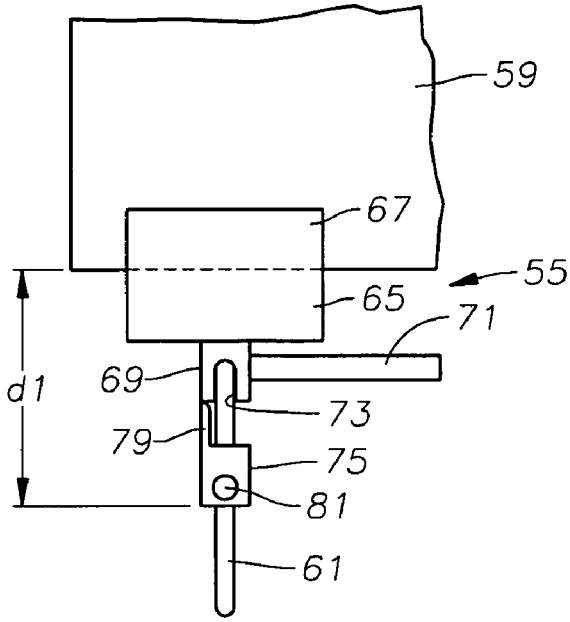
FIG. 7 is a rear elevational view of the siding tool of FIG. 6.
Figure 8:
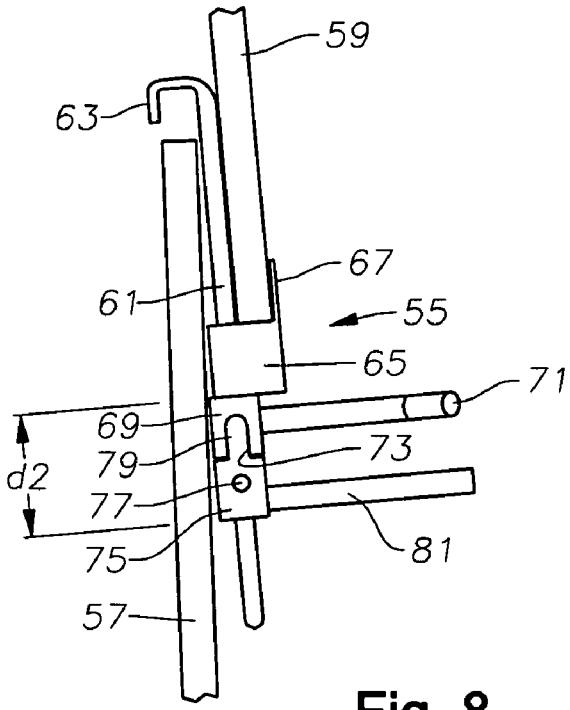
FIG. 8 is a side elevational view of the tool of FIG. 6, with the rod and hook shown in an upper position.

While in the position of FIGS. 6 and 7, lug 79 is misaligned with groove 73, thus contacts a lower shoulder on spacer 69. The lower end of collar 75 is spaced a distance d1 from the lower edge of upper plank 59. Rotating spacer 69 to a position where lug 79 is aligned with groove 73, allows the workman to push collar 75, rod 61 and hook 63 upward relative to support 65. In this position, as shown in FIG. 8, the distance from the lower end of collar 65 to the lower edge of upper shelf 59 is distance d2, which is less than distance d1. The locations of lug 79 and groove 73 could be interchanged, with lug 79 extending downward from spacer 69 and groove 73 formed in collar 75.

In the operation of the embodiment of FIGS. 6-9, the workman hangs one or more of tools 55 on plank 57 with hook 63 overlying the upper edge. The workman rotates spacer 69 to a misaligned position as shown in FIGS. 6 and 7. A second plank 59 is placed on shelf support 65, and the weight of plank 59 will transfer through spacer 69, lug 79, collar 75 to rod 61 and hook 63.

Figure 9:
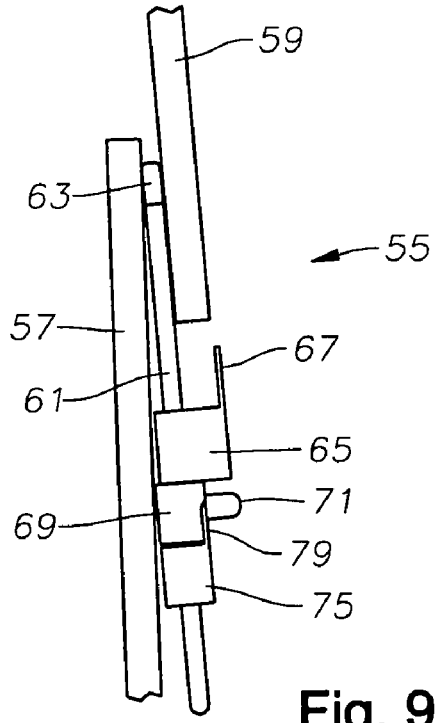
FIG. 9 is a side elevational view of the tool of FIG. 6 with the hook rotated 90 degrees and the tool in the process of being withdrawn.

After fastening plank 59, the workman rotates spacer 69 approximately 90 degrees to the aligned position. Groove 73 will now align with lug 79, allowing the workman to push rod 61 and hook 63 upward so that hook 63 clears the upper edge of plank 57, as shown in FIG. 8. The workman then rotates rod 61 and hook 63 with arms 81 or 71 to place hook 63 in a plane parallel with the plane containing plank 57. The workman then pulls hook 63 downward as shown in FIG. 9.

The invention has significant advantages. The tool will easily assemble with the plank and provide support the next upper plank. The tool is readily released from engagement with the first plank and readily withdrawn because in both embodiments, the hook rotates 90 degrees from the engaged position. The overlap of the planks can be adjusted by the tool.

While the invention has been shown in only two of its forms, it should be apparent to those skilled in the art that it is not so limited but is susceptible to various changes without departing from the scope of the invention.

What is claimed is:

1. A tool for positioning overlapping siding planks, comprising:

an elongated member having a hook on an upper end for placement over an upper edge of a first plank fastened to a structure, defining an engaged position;

a support carried by the elongated member for engagement with a lower edge of a second siding plank overlapping the first plank to hold the second plank while the second plank is being fastened to the structure and while the hook is in the engaged position;

the elongated member and the hook being upwardly movable from the engaged position, and the hook rotatable to a disengaged position substantially 90 degrees from the engaged position, to allow the hook and elongated member to be withdrawn from between the first and second planks; and wherein at least an upper portion of the elongated member rotates in unison with the hook while the hook moves from the engaged to the disengaged position.

2. The tool according to claim 1, further comprising a handle rigidly secured to a lower portion of the elongated member.

3. A tool for positioning overlapping siding planks, comprising:

an elongated member having a hook on an upper end for placement over an upper edge of a first plank fastened to a structure, defining an engaged position;

a support carried by the elongated member for engagement with a lower edge of a second siding plank overlapping the first plank to hold the second plank while the second plank is being fastened to the structure and while the hook is in the engaged position;

the elongated member and the hook being upwardly movable from the engaged position, and the hook rotatable to a disengaged position substantially 90 degrees from the engaged position, to allow the hook and elongated member to be withdrawn from between the first and second planks; and wherein the elongated member is rotatable relative to the support.

4. The tool according to claim 3, wherein the support comprises:

a shelf member; and a back extending upward from a rearward edge of the shelf member.

5. The tool according to claim 3, wherein the elongated member extends through a hole in the support.

6. The tool according to claim 3, wherein:

the lower portion of the elongated member is manually twistable relative to the hook while the hook is in the engaged position, creating torque through the elongated member;

a retainer mechanism retains the torque when engaged; and upward movement of the elongated member relative to the support while the elongated member is under torque pushes the hook above the upper edge of the first plank, the torque causing the hook to spring back to the disengaged position.

7. A tool for positioning overlapping siding planks, comprising:

an elongated member having a hook on an upper end for placement over an upper edge of a first plank fastened to a structure, defining an engaged position;

a support carried by the elongated member for engagement with a lower edge of a second siding plank overlapping the first plank to hold the second plank while the second plank is being fastened to the structure and while the hook is in the engaged position; and the elongated member and the hook being upwardly movable from the engaged position, and the hook rotatable to a disengaged position substantially 90 degrees from the engaged position, to allow the hook and elongated member to be withdrawn from between the first and second planks;

a spacer located below the support, the spacer being axially movable and rotatable relative to the elongated member; and a mating lug and groove between the elongated member and the spacer that when misaligned prevent upward movement of the elongated member relative to the support and transfer weight of the second plank from the support to the elongated member, and when aligned, allow upward movement of the elongated member to position the hook above the upper edge of the first plank so that the hook can be rotated to the disengaged position.

8. A tool for positioning overlapping siding planks, comprising:

a handle for grasping by a user;

a guide member carried by the handle;

an elongated torsion member extending through and above the guide member and having a hook on an upper end for placement over an upper edge of a first plank fastened to a structure, the torsion member having a lower end secured to the handle;

a support carried by the guide member below the hook for supporting a lower edge of a second siding plank overlapping the first plank;

the handle and the lower end of the torsion member being rotatable relative to the guide member and the hook while the hook engages the first plank, applying torque to the torsion member;

a retainer mechanism between the tube and the handle that retains the torque within the torsion member after the handle has been rotated a selected amount, defining a cocked position; and wherein upward movement of the handle while in the cocked position moves the hook upward above the upper edge of the first plank, wherein the torque causes the hook to rotate back the selected amount to allow the hook to be withdrawn from between the planks.

9. The tool according to claim 8, wherein the torsion member comprises a steel spring.

10. The tool according to claim 8, wherein the guide member comprises a tube.

11. The tool according to claim 8, wherein:

the guide member slides within a hole in the handle; and the retainer mechanism comprises:

a lug and groove arrangement on the guide member and in the hole that prevents upward movement of the handle relative to the guide tube while misaligned and allows upward movement of the handle relative to the guide tube while aligned.

12. The tool according to claim 11, wherein the retainer mechanism further comprises:

a detent arrangement between the handle and the guide tube, that provides a stop during rotation of the handle when the lug and groove arrangement are aligned.

13. The tool according to claim 11, wherein the torsion member comprises a steel strip that is permanently bent on its upper end to define the hook, and is permanently twisted along a portion of its length.

14. A tool for positioning overlapping siding planks, comprising:

a rod having a hook on an upper end for placement over an upper edge of a first plank fastened to a structure, defining an engaged position;

a support for engagement with a lower edge of a second siding plank overlapping the first plank, the support having a hole through which the rod extends and being rotatable and axially movable relative to the rod;

a spacer below the support and having a hole through which the rod extends, the spacer being rotatable relative to the rod and the support; and a mating lug and groove arrangement between the spacer and the rod that when misaligned, prevents upward movement of the rod relative to the spacer and the support, and when aligned allows upward movement of the rod relative to the spacer and the support to disengage the hook from the engaged position and allow rotation of the rod substantially 90 degrees from the engaged position.

15. The tool according to claim 14, further comprising:

a handle mounted to the rod below the spacer for rotating the rod, the handle being in engagement with the spacer to limit downward movement of the support on the rod while the hook is in the engaged position.

16. The tool according to claim 14, wherein the support comprises:

an upward facing shelf member; and a back extending upward from a rearward edge of the shelf member.

17. The tool according to claim 14, wherein the spacer comprises:

a collar; and an arm extending laterally from the collar for manual engagement to rotate the collar.

18. The tool according to claim 14, further comprising:

a collar mounted to the rod below the spacer;

the lug being formed selectively on either the collar or the spacer, and the groove being selectively formed on the other of the collar or the spacer.

19. The tool according to claim 18, further comprising an arm extending laterally from the collar for rotating the collar and the rod.

* * * * *